United States Patent [19]

Snyder et al.

[11] 4,030,596

[45] June 21, 1977

[54] CARTONS

[76] Inventors: Robert O. Snyder, 51 Arthur Street, S.; Otto W. Klink, 26 Center Street, both of Elmira, Ontario, Canada

[22] Filed: May 24, 1976

[21] Appl. No.: 689,484

[52] U.S. Cl. ..... 206/45.26; 229/17 B; 206/45.21; 229/7 R; 248/152

[51] Int. Cl.[2] ..... B65D 5/52; B65D 25/24

[58] Field of Search ..... 229/17 R, 17 B, 17 M, 229/17 RS, 7 R; 206/44.12, 44.25, 45.26; 312/42, 45; 248/152, 174; 211/49 B

[56] References Cited

UNITED STATES PATENTS

| | | | |
|---|---|---|---|
| 1,485,700 | 1/1924 | Schoder et al. | 206/45.21 |
| 1,497,536 | 6/1924 | Billstein | 206/45.21 |
| 1,803,851 | 5/1931 | Horwath | 229/7 R |
| 1,862,685 | 6/1932 | Kennett | 206/45.21 X |
| 2,787,371 | 4/1957 | Curtis | 206/45.21 |
| 3,300,115 | 1/1967 | Schauer | 229/17 B X |
| 3,455,439 | 7/1969 | Weiner | 206/45.26 |

FOREIGN PATENTS OR APPLICATIONS

| | | | |
|---|---|---|---|
| 175,552 | 1/1905 | Germany | 229/17 B |

*Primary Examiner*—Davis T. Moorhead
*Attorney, Agent, or Firm*—Anthony J. Casella

[57] ABSTRACT

The invention relates to a carton and a one-piece blank for forming it, the carton having a detachable portion defining an article dispensing aperture in one wall and also serving, when cooperating with the bottom of the carton, as a pedestal so as to incline the carton from the vertical so that the articles will always be presented to said aperture.

5 Claims, 6 Drawing Figures

CARTONS

This invention relates to cartons and blanks for forming said cartons, each of the latter having an article dispensing aperture therein.

Cartons having article dispensing apertures therein are well known. For instance, it is known, vide U.S. Pat. Nos. 1,956,642 (Einson) and 3,258,114 (King) as well as British Pat. No. 205,600 (Shirley) to provide such cartons with at least one supporting stand or pedestal cooperating with the bottom of the carton so as to incline the latter towards the front whereby the contents or articles will be displayed more advantageously through the dispensing aperture. However, although each of these arrangements has been formed from a one-piece blank, the panel forming the pedestal has been additional to that defining the dispensing aperture and the remainder of the carton. The present invention overcomes this disadvantage and, hence, effects a saving in material.

It is also known vide U.S. Pat. Nos. 1,341,893 (Fitzgerald), 1,668,171 (Pratt), 1,803,851 (Horvath), 1,840,439 (Ewell) and 2,142,883 (Chaney) to provide cartons, having a dispensing aperture, with a supporting stand or pedestal to incline the carton. However, and in these examples, the carton is formed from one blank and the stand or pedestal from another blank. Again, the present invention offers a saving in material.

Furthermore, U.S. Pat. No. 1,862,685 (Kennett) discloses a carton formed from a one-piece blank, portions of which define dispensing openings as well as a discharge opening and a supporting stand. The article dispensing openings in Kennett's arrangement are circular and are located in the front of the carton while the salesman partially pushes each article through the said openings by placing his hand through the discharge opening located at the back of the carton. The portion of the carton defining the discharge opening is adapted to form the supporting stand. In the present invention, however, the contents of the carton are presented to the dispensing contents of the carton are presented to the dispensing aperture under gravity and the portion of the blank defining the dispensing aperture also forms the pedestal.

The invention is illustrated, by way of example, in the accompanying drawings, in which.

Figures 1, 2, 3, 4, 5, 6:
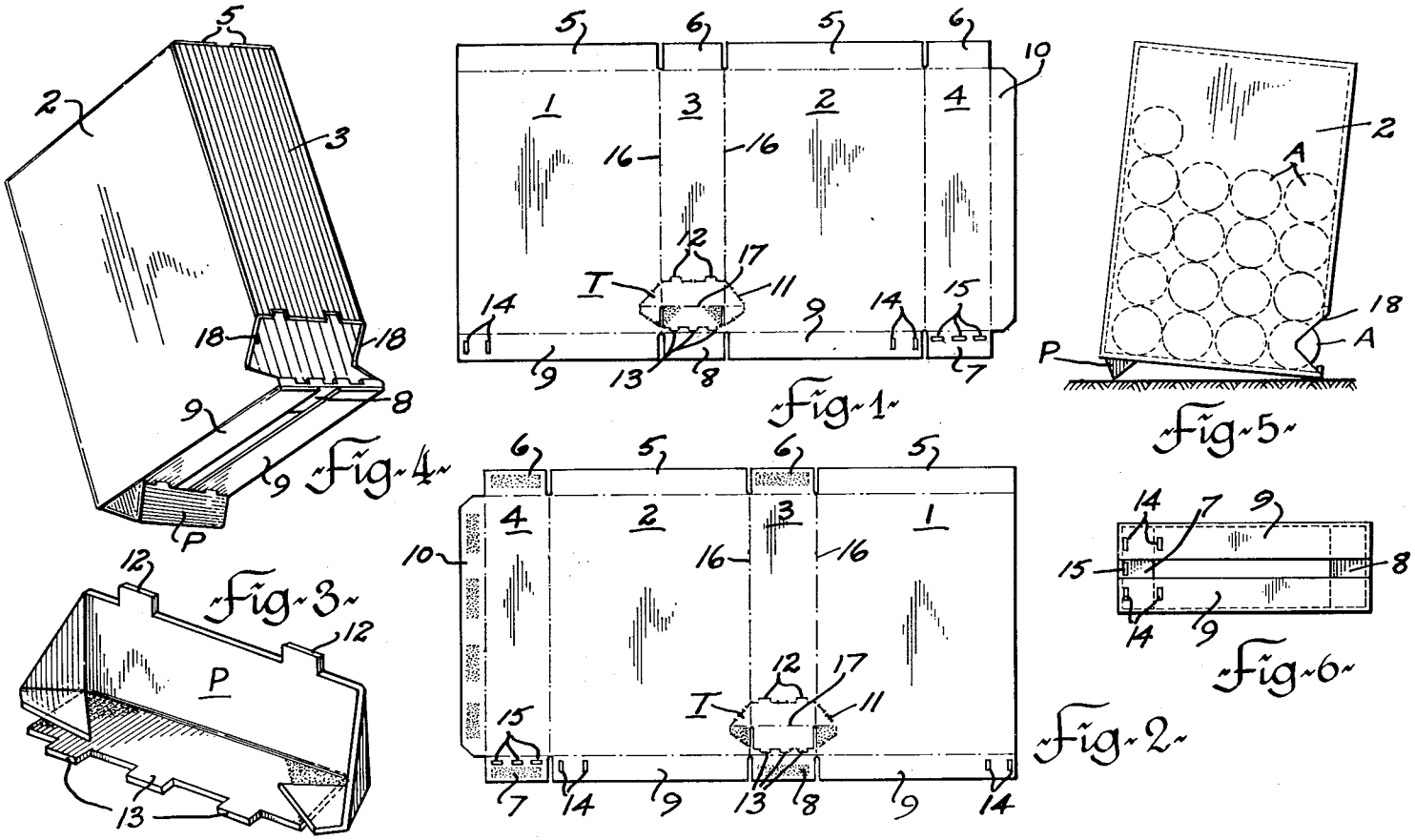
FIG. 1 is a plan view of a one-piece blank from which the carton is formed.
FIG. 2 is a similar view of the obverse side thereof.
FIG. 3 is a detail view.
FIG. 4 is a perspective view of an erected carton particularly showing its underside.
FIG. 5 is a side elevation of the carton.
FIG. 6 is a further detail view.

Referring to the drawings, and to FIGS. 1 and 2 in particular, the one-piece blank shown therein is cut and scored to provide a plurality of panels a pair of which, 1,2 ultimately serve as a pair of side walls, while others, 3,4 ultimately serves as a pair of mutually opposed end walls. Panels 5,6 ultimately serve as top side and end closure flaps, and panels 7,8 ultimately serve as bottom end closure flaps with further panels 9 serving as bottom side closure flaps. Panel 4 is also provided with an adjacent sub-panel 10 which ultimately serves as the "manufacturer's flap".

It will been seen that portions of panels 1–3 are bounded by a line of severance 11 which defines a tab T provided with sets of tongues, 12,13.

Each bottom side closure flap 9 is provided with a pair of slots 14 therein whereas the bottom side closure flap 7 is provided with similar slots 15 extending normal to the slots 14. Additionally, one face (as viewed in FIG. 2) of flaps 6,7,8 and 10 coated with pressure sensitive adhesive as are spaced portions of tab T. The obverse side of the blank, as is shown in FIG. 1, has selected portions of flaps 5 and 9 and tab T coated in a similar manner.

In known manner, the blank is folded so as to form a carton having a wall structure formed by panels 1–4, a top closure formed by panels 5,6, and a bottom closure formed by panels 7–9. The contents of the carton are preferably cylindrical articles A such as, for example, tinned food etc.

When the retailer requires that the carton be placed on a shelf for display purpose and subsequent sales of the articles therein, he gently presses on the tab T and removes it from the carton. The end portions, defined by score-lines 16,17 and line of severance 11, of the tab T are then folded so as substantially to assume the positions shown in FIG. 3 where the coated end portions of tab T will adhere to the coated portions of the obverse face of said tab so as to form a pedestal P. The pedestal is then "married" to the bottom of the carton when the retailer inserts the tongues 12,13 into the slots 14,15 as is shown in FIG. 4.

Thus, when such a carton is placed on a shelf or store counter, the pedestal P will incline the back of the carton thus permitting the cylindrical articles to be presented, under gravity, to the dispensing aperture located in the front of the carton and where, due to the substantially v-shaped cut-outs 18 formed in the side walls of the carton, the ends of said articles can easily be grasped for withdrawal from the carton.

We claim:

1. A carton having a wall structure consisting of mutually opposed side and end walls; a bottom; and a top; a removable tab defining an article dispensing aperture in a selected one of said walls adjacent said bottom and having its ends extending into the two neighbouring walls; and a pedestal cooperating with said bottom and inclining said carton from the vertical towards said aperture so that said articles are always presented by gravity to said aperture for removal therefrom, said pedestal being formed by said tab upon removal from said wall and upon said cooperation with said bottom.

2. A carton according to claim 1 wherein the ends of said aperture are substantially V-shaped.

3. A carton according to claim 2 including tabs on said tab and cooperating slots in said bottom.

4. A one-piece blank for forming a carton, said blank being cut and scored to provide a plurality of interconnected panels certain of which subsequently form a wall structure consisting of mutually opposed side and end walls, while others subsequently form a bottom with slots therein and a top; portions of selected adjacent wall panels being cut and scored to form a tab capable of removal from said selected wall panels to define an article dispensing aperture in said carton; said tab being provided with tongues and, upon its said removal and upon a folding manipulation and cooperation of its tongues with the slots in the bottom of the carton, also serving as a pedestal to incline the carton from the vertical towards said aperture so that said articles are always presented by gravity to said aperture for removal therefrom.

5. A blank according to claim 4 wherein the ends of said aperature are substantially V-shaped.

* * * * *